United States Patent [19]

Ludwig

[11] 4,188,701

[45] Feb. 19, 1980

[54] HINGE PIN REMOVER

[76] Inventor: Joseph B. Ludwig, 518 N. Howard Ave., Lee's Summit, Mo. 64063

[21] Appl. No.: 900,804

[22] Filed: Apr. 27, 1978

[51] Int. Cl.[2] ..... B25B 27/14

[52] U.S. Cl. ..... 29/275; 254/131; 29/253

[58] Field of Search ..... 29/275, 276, 253, 254, 29/255, 280; 254/25, 131; 145/46; 81/52.35, 52.3

[56] References Cited

U.S. PATENT DOCUMENTS

| | | | |
|---|---|---|---|
| 1,736,190 | 11/1929 | Domagall | 145/46 |
| 3,166,757 | 1/1965 | Downs | 145/46 |
| 3,602,969 | 9/1971 | Provost | 29/275 |
| 3,689,977 | 9/1972 | Crabbe | 29/280 |

*Primary Examiner*—James L. Jones, Jr.
*Attorney, Agent, or Firm*—Lowe, Kokjer, Kircher, Wharton & Bowman

[57] ABSTRACT

For removing a hinge pin, a tool having a wedge-shaped head mounted on a shank equipped with a support projection to receive the hinge. The head includes an impact surface for hammering the wedge portion between the hinge and the head of the hinge pin. A striker plate perpendicular to the tool shank receives impact blows to dislodge the pin from the hinge.

4 Claims, 6 Drawing Figures

HINGE PIN REMOVER

BACKGROUND AND SUMMARY OF THE INVENTION

Many are the house dwellers familiar with the difficulties involved in removing hinge pins associated with doors, cabinets and the like. Such may be necessary when a door is to be temporarily removed from its hinges. This operation characteristically involves an assortment of screwdrivers, chisels, pliers and hammers. For example, a screwdriver or chisel may typically be hammered into the margin between the bulbous head of the hinge pin and the upper surface of the hinge to slightly displace the hinge pin relative to the hinge. Next, the screwdriver may be canted beneath the hinge pin head and the pin can be pounded upwardly out of its associated hinge. Alternatively, a pair of pliers may be applied to the head of the pin to wrench and twist it from the hinge.

All too often the net result of these operations is frayed nerves and frustration for the workman together with marred, scratched and gouged woodwork and hardware. At times, the damage caused by accidental tool slippage on the woodwork and hardware requires substantial repair or replacement although the initial task involved nothing more than temporarily removing a door from its hinges.

Gouged woodwork may not be the most serious damage resulting from attempts to remove a hinge pin. Cuts, lacerations and bruises on the hands and fingers commonly result when an implement slips from engagement with the hinge pin or a hammer fails to strike an intended mark.

There is a need, therefore, for simple and effective means of safely removing a hinge pin without unsightly damage to the adjacent woodwork and hardware. The primary object of this invention is to provide a hinge pin remover to meet this need.

More specifically, the primary object of this invention is to provide a hinge pin remover which may be employed to safely and effectively remove the hinge pin from a hinge without slippage and misplacement which can result in gouged and scratched woodwork and hardware.

Another object of the invention is to provide a hinge pin remover of the character described which may be effectively employed in full safety to the workman using the tool. Cut, pinched and bruised fingers no longer need be commonplace in the removal of a hinge pin. The positive manner in which the tool of the present invention is employed to remove a hinge pin virtually eliminates these dangers.

A further object of the invention is to provide a hinge pin remover of simple and durable construction with particular emphasis on economy and compactness so as to represent a valuable addition to any toolbox.

Other and further objects of the invention, together with the features of novelty appurtenant thereto, will appear in the course of the following description of the drawing.

DESCRIPTION OF THE DRAWING

In the accompanying drawing, which forms a part of the specification and is to be read in conjunction therewith, and in which like reference numerals are employed to indicate like parts in the various views.

Figure 1:
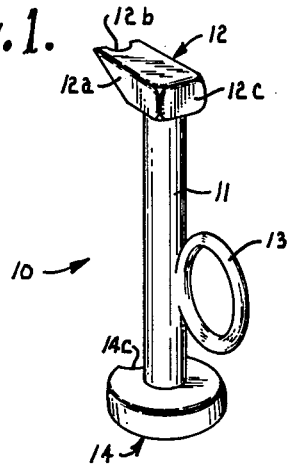
FIG. 1 is a perspective view of a hinge pin remover constructed in accordance with a preferred embodiment of the invention.

Referring now to the drawings in more detail, the hinge pin remover, generally designated by the numeral 10, includes an elongate shank portion 11. Integrally joined to the upper end of the shank 11 is a head member 12. The forward end of the head 12 preferably tapers from the lower surface to the upper surface thereof to provide a generally wedge-shaped forward projection **12*a*. The wedge-shaped portion 12*a* includes a central notch 12*b* providing bifurcated forks to engage the shank of the hinge pin at least at two different points. The rearward end of the head 12 provides a striker surface 12*c*** which may be tapped with a hammer or similar implement as will become apparent.

Located on the shank 11 at a location diametrically opposite the forward projection **12*a* is a finger ring 13. The ring 13 is centrally disposed in vertical alignment on the shank 11** to facilitate use by both left-handed and right-handed persons.

Figure 2:
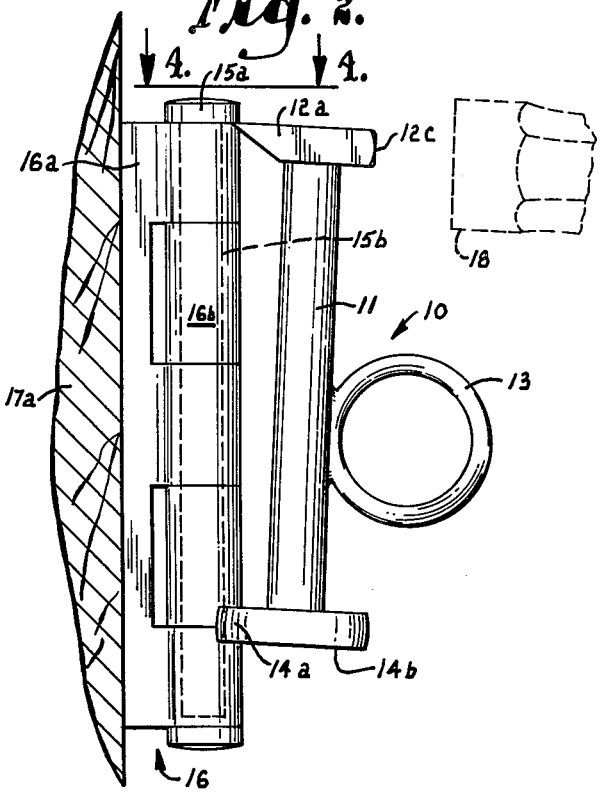
FIG. 2 is a side elevational view of the hinge pin remover shown in initial application to remove a hinge pin.
Figure 3:
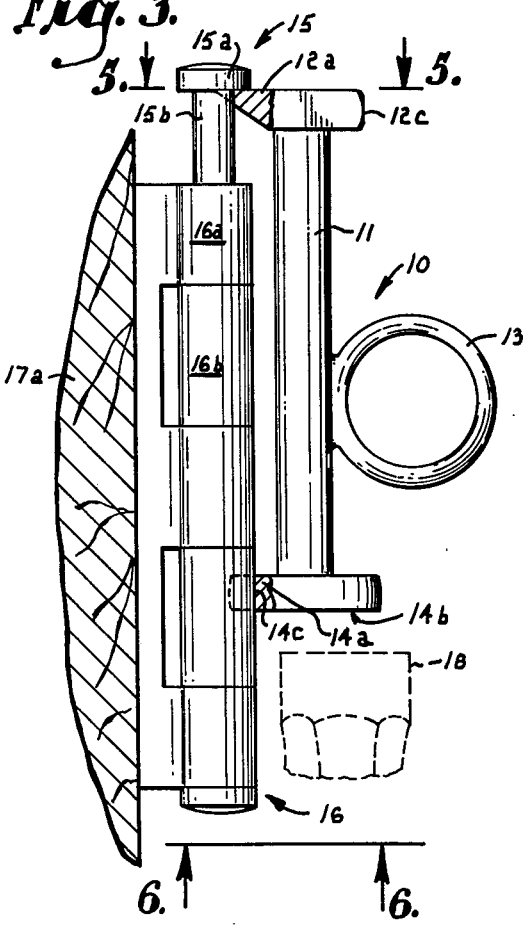
FIG. 3 is a side elevational view similar to that of FIG. 2 but illustrating application of the tool to partially remove the hinge pin.
Figure 4:
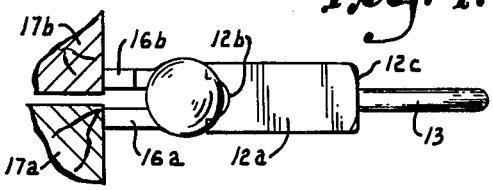
FIG. 4 is a top plan view taken along line 4—4 of FIG. 2 in the direction of the arrow.

Secured to the lower end of the shank 11 is a base member 14 which includes a combination support foot **14*a* and a striker plate 14*b*. The support foot 14*a* extends outwardly from the shank 11 at a location beneath the wedge projection 12*a* of the head 12 and includes a central notch 14*c* to receive the hinge and engage it at least at two different points. Thus, when the head 12 is engaged against the pin as shown in FIGS. 2 & 3, the foot 14*a*** supports the tool substantially parallel with the hinge itself.

The base 14 additionally supplies a striker surface **14*b*** which may be hammered upon with a suitable implement as will become apparent.

It is not necessary for the support portion **14*a* and the striker 14*b* to be integrally fabricated as one piece as illustrated in the drawings. It is vitally important, however, for the support 14*a* to be positioned on the shank 11 a distance beneath the head 12 less than the length of the hinge. In other words, the support 14*a* must bear against the hinge when the head 12** engages the hinge pin.

In use the implement 10 is employed to remove the hinge pin 15 from a conventional hinge 16 having a pair of complementary hinge plates **16*a* and 16*b*. The hinge 16 is typically secured to wooden surfaces 17*a* and 17*b* joined in a hinged relationship. In order to remove the hinge pin 15 from the hinge 16 shown in FIG. 2, the removal tool 10 is gripped by the ring member 13. This may be conveniently done by extending the index finger through the ring member 13. Next, the tool 10 is placed in the position illustrated in FIG. 2, with the foot portion 14*a* biased against the hinge itself and the bifurcated forks of the wedge 12*a* engaging the intersection of the pin head 15*a* with the top surface of the hinge 16**.

If the pin 15 is loosely received by the hinge plates 16*a* and 16*b*, it may be only necessary to push inwardly on the wedge portion 12*a* in order to raise the pin 15 slightly upwardly until the bifurcated forks engage the shank 15*b* of the pin. When the pin 15 is tightly lodged in the hinge 16 (as for example may be the case when the hinge is corroded or when the pin otherwise fits tightly in the hinge), the striker plate 12*c* of the head 12 may be tapped by means of a hammer 18 or similar implement in order to force the wedge 12*a* under the pin head 15*a* until the pin shank 15 is received by the notch 12*b* of the tool head 12.

If the pin 15 is loosely received in the hinge 16, it is only necessary to then raise the tool 10 with an upward motion while engaging the support foot 14*a* against the hinge 16 itself and maintaining contact of the wedge 12*a* beneath the pin head 15*a*. If, on the other hand, the pin 15 fits snugly in the hinge 16, then striker plate 14*b* may be firmly tapped with a hammer 18 in order to drive the pin 15 upwardly and out of the hinge 16.

Figure 5:
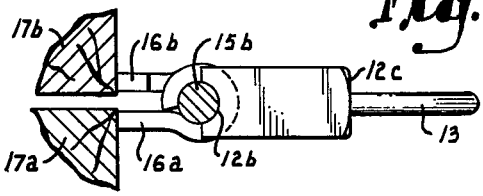
FIG. 5 is a top plan view with the hinge pin shown in section, taken along line 5—5 of FIG. 3 in the direction of the arrow.
Figure 6:
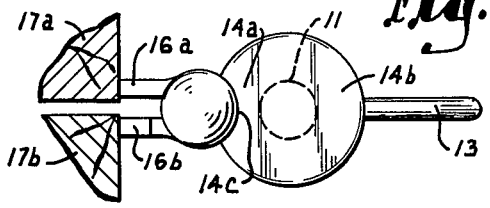
FIG. 6 is a bottom plan view taken along line 6—6 of FIG. 3 in the direction of the arrow.

At this point it will be apparent the hinge pin remover 10 of this invention may be safely and effectively used to remove a hinge pin without damage to associated woodwork and hardware caused by tool slippage and the like. This desirable result is achieved in part by the positive manner in which the tool contacts the hinge pin 15 and hinge 16. In this regard it should be noted in FIGS. 5 & 6 that the notch 12*b* of the head 12 and the notch 14*c* of the base 14 are contoured to matingly receive respectively the shank 15*b* of the pin 15 and the hinge 16. Of course it is not necessary for notches 12*b* and 14*c* to be contoured identically complementary to the corresponding hinge parts. It is only necessary the notches be so formed to engage the hinge parts at least at two points. In other words, the notches 12*b* and 14*c* may be V-shaped for example and could engage each of the pin shank 15*b* and hinge 16 at two different points on the surface thereof in order to provide the necessary stability for the tool 10 in application.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

I claim:

1. A tool for removing from a hinge a hinge pin having a bulbous head and a shank portion of fixed length, said tool comprising:

a shank;

a bifurcated wedge secured to the upper end of the shank for placement between the hinge and the bulbous head of the hinge pin and for engagement with the undersurface of the bulbous head of the hinge pin;

a first striker plate substantially parallel to the shank and adapted to receive impacts to force the wedge between the hinge pin and the undersurface of the hinge pin head;

a support foot secured to the shank a distance from the wedge less than the length of the shank portion of the hinge pin and aligned on the shank beneath the wedge, said support foot including a hinge receiving notch adapted to engage the hinge at least at two different points when the wedge is disposed between the hinge and the hinge pin head;

a second striker plate substantially perpendicular to the shank and adapted to receive impacts to force the pin from the hinge when the wedge contacts the undersurface of the hinge pin head.

2. The tool as in claim 1 wherein said bifurcated wedge includes an upper surface, a lower surface substantially parallel to said upper surface, and a tapered end surface tapering from said lower surface of the wedge to said upper surface thereof.

3. The tool as in claim 1 wherein said wedge includes a notch in the end thereof to receive the shank portion of the hinge pin and to engage the shank portion at least at two different points.

4. The tool as in claim 1 wherein said first striker plate is integrally joined with said bifurcated wedge and is arranged on the shank opposite the bifurcated wedge.

* * * * *